US007391283B2

(12) United States Patent
Kearns

(10) Patent No.: US 7,391,283 B2
(45) Date of Patent: Jun. 24, 2008

(54) RF SWITCH

(75) Inventor: Brian Kearns, Dublin (IE)

(73) Assignee: TDK Corporation, Tokyo (JP)

( * ) Notice: Subject to any disclaimer, the term of this patent is extended or adjusted under 35 U.S.C. 154(b) by 450 days.

(21) Appl. No.: 11/288,201

(22) Filed: Nov. 29, 2005

(65) Prior Publication Data

US 2007/0120619 A1 May 31, 2007

(51) Int. Cl.
*H01P 1/15* (2006.01)

(52) U.S. Cl. ..... 333/103; 333/262

(58) Field of Classification Search ..... 333/103, 333/104, 262, 101, 132, 136
See application file for complete search history.

(56) References Cited

U.S. PATENT DOCUMENTS 3,475,700 A 10/1969 Ertel
4,220,874 A 9/1980 Iwata et al.
5,519,364 A 5/1996 Kato et al.
5,914,544 A * 6/1999 Tanaka et al. ..... 307/130
6,448,868 B2 * 9/2002 Kato et al. ..... 333/103
6,586,786 B2 * 7/2003 Kitazawa et al. ..... 257/275
6,650,199 B2 * 11/2003 Dobrovolny ..... 333/103
6,917,258 B2 * 7/2005 Kushitani et al. ..... 333/103
2004/0266378 A1 12/2004 Fukamachi et al.

* cited by examiner

*Primary Examiner*—Benny Lee
*Assistant Examiner*—Alan Wong
(74) *Attorney, Agent, or Firm*—Oliff & Berridge, PLC

(57) ABSTRACT

An SPNT switch has at least two operating states and comprises N circuit branches. Each circuit branch comprises a first input/output port connected to a second input/output port via a series active device, and a phase shifting component connected in series with a shunt active device. When the shunt active device is in an on state, the reflection co-efficient due to a path to ground from the series active device via the phase shifting component and the shunt active device is +1. At least one DC terminal controls the state of the active devices, whereby in one of the operating states of the switch, both active devices are in the on state simultaneously, and in another of the operating states, both active devices are in an off state simultaneously.

9 Claims, 6 Drawing Sheets

RF SWITCH

FIELD OF THE INVENTION

The present invention relates to an RF switch especially for use in antenna switch modules or RF modules for mobile devices.

BACKGROUND OF THE INVENTION

Electronic switches which are suitable for radio frequency (RF) applications and which can be switched between several states of operation by the application of one or more bias voltages to one or more control terminals have widespread applications in such RF devices and components.

For example, modem cellular wireless telephony handsets are generally capable of operating on several different frequency bands and usually require an RF switch to alternately connect a single antenna to the various TX and RX circuit sections of the handset. The RF switch of a cellular handset is often grouped together with RF filters and other RF components in what is commonly referred to as an antenna switching module (ASM) or front end module (FEM). Various applications of RF switches in antenna switching modules are illustrated by Fukamachi et al in US patent application US20040266378A1. It can be seen that for these applications SP2T, SP3T and SP4T RF switches are required. Many other applications for RF switches exist, and the type of switch required is usually governed by parameters specific to the particular application.

An SP2T RF switch includes a common RF port, a first RF input/output port, and a second RF input/output port, the switch has an operation frequency range defined by a lower frequency limit $f_L$ and an upper frequency limit $f_U$. An SP2T RF switch furthermore includes two circuit branches where each circuit branch comprises a first end and a second end. The first end of one circuit branch is connected to the first input/output port of the switch and the first end of the other circuit branch is connected to the second input/output port of the switch. The second ends of both circuit branches are connected to the common port of the switch. There are two states of operation of an SP2T RF switch: a first state of operation and a second state of operation. In the first state of operation, a low insertion loss path for RF signals within the operating frequency range of the switch exists between the first input/output port and the common port via one of the circuit branches, and simultaneously there is high isolation between the common port of the switch and the second input/output port for RF signals within the same frequency range; in the second state of operation, a low insertion loss path exists between the second input/output port and the common port via the other circuit branch for RF signals within the operating frequency range of the switch, and simultaneously there is high isolation between the common port of the switch and the first input/output port for RF signals within the same frequency range. Common embodiments of an SP2T RF can furthermore be switched between the first state of operation and the second state of operation actively by the application of a particular combination of control voltages to a number of control terminals of the switch.

A number of prior art embodiments of SP2T RF switches are described below; each prior art embodiment includes a first circuit branch and a second circuit branch where each circuit branch further includes one or more series or parallel active devices, where each active device has two states: an on state where the active devices presents a low impedance path to an RF signal, and an off state where the active devices presents a high impedance path to an RF signal, and where the state of the active device is controlled by the application of a bias voltage to the active device.

In U.S. Pat. No. 3,475,700, Ertel describes several transmit/receive SP2T RF switches which can alternately connect a TX port 14 or an RX port 16 to a common antenna 12. The switch depicted by Ertel in FIG. 1 of U.S. Pat. No. 3,475,700 comprises two series connected PIN diodes 18, 20, each of which can be switched between respective on-states and off-states by the application of a pair of control voltages to control terminals 27, 28. For example, if a negative voltage is applied to control terminal 27, and control terminal 28 is maintained at zero volts, then PIN diode 18 will be in the on-state, and PIN diode 20 will be in the off-state. Thus, TX signals entering the switch at port 14, will be able to pass through the on-state PIN diode 18 directly to the antenna 12, the TX signal will be simultaneously blocked from the RX port 16 by the off-state PIN diode 20. Conversely, if control terminal 27 is maintained at zero volts, and if a negative voltage is applied to control terminal 28, then RX signals entering the switch at the common antenna 12, will be fed directly to the RX port 16, and will be isolated from the TX port 14.

Another embodiment of an SP2T RF switch is depicted by Ertel in FIG. 6 of U.S. Pat. No. 3,475,700; this comprises two parallel connected PIN diodes 166,178, which are switched between respective on-states and off-states by the application of suitable control voltages to control terminals 170, 176, 182. The operation of the SP2T RF switch depicted by Ertel in FIG. 6 of U.S. Pat. No. 3,475,700 is broadly similar to the SP2T RF switch of FIG. 1 of U.S. Pat. No. 3,475,700, except that in the embodiment shown in FIG. 6, the electrical lengths of the pair of microstrip transmission lines between junctions 164 and 158, and between junctions 177 and 158 are both one quarter of a wavelength of the centre frequency of the operating band of the switch. In this way, when one or the other of PIN diodes 166, 178 are in the on-state, the impedance presented at junction 158 by the on-state PIN diode becomes infinitely large, thereby isolating the branch of the circuit including the switched on diode from the antenna 12.

As mentioned above, in each state of operation of an SP2T RF switch, there is a low loss path between the common port of the switch and one of the input/output ports, and simultaneously there is high isolation between the common port of the switch and the other of the input/output ports for RF signals within the operating frequency range of the switch. The principal disadvantage of the various SP2T RF switch embodiments described in U.S. Pat. No. 3,475,700 by Ertel is that the level of isolation offered by each embodiment is limited by the impedance of a single PIN diode in the off-state (FIG. 1) or in the on-state (FIG. 6). Ideally the off-state impedance of a PIN diode is infinite, and the on-state impedance of a PIN diode is zero, this would give rise to infinite isolation for each embodiment, however typical commercially available PIN diodes have an off-state impedance of one or two thousand Ohms, and an on state impedance of one or two Ohms, so that conventional PIN diodes will provide approximately 25 dB of isolation if deployed in the circuits shown in FIG. 1 or FIG. 6 of U.S. Pat. No. 3,475,700.

The isolation of an SP2T PIN diode RF switch can be improved to approximately 40dB if 4 PIN diodes are employed in the switch circuit, two in each circuit branch of the switch. One such SP2T RF switch is described by Kato et al in U.S. Pat. No. 5,519,364. The switch depicted by Kato et al in FIG. 1 of U.S. Pat. No. 5,519,364 is a high isolation SP2T RF switch comprising a pair of shunt PIN diodes in each circuit branch. Another type of SP2T switch architecture is described by Iwata et al, in U.S. Pat. No. 4,220,874. Iwata et al describe a number of embodiments of SP1IT and SP2T RF switches which employ a shunt PIN diode and a series PIN diode in each circuit branch. The SP2T RF switch depicted by Iwata et al in FIG. 4 of U.S. Pat. No. 4,220,874 comprises a pair of shunt PIN diodes $D_2$, $D_4$ and a pair of series PIN diodes $D_1$, $D_3$. The biasing of diodes D1, $D_2$, $D_3$ and $D_4$ is achieved by application of a positive voltage (denoted by $V_1$ in U.S. Pat. No. 4,220,874) or zero volts (denoted by $V_2$ in U.S. Pat. No. 4,220,874) to control terminals $S_1$ and $S_2$ of the switch. The use of two PIN diodes per circuit branch as illustrated in U.S. Pat. No. 5,519,364 and U.S. Pat. No. 4,220,874 offers a substantial increase in the isolation of the switch. FIG. 1 shows a prior art SP2T RF switch according to the embodiment depicted by Iwata et al in FIG. 4 of U.S. Pat. No. 4,220,874.

The SP2T RF switch of FIG. 1 comprises 3 ports: a common port $P_1$, a first input/output port $P_2$, and a second input/output port $P_3$. The switch includes two circuit branches $B_1$, $B_2$, where input/output port $P_2$ is connected to the one end of circuit branch $B_1$, and where input/output port $P_3$ is connected to one end of circuit branch $B_2$, and where the other ends of both circuit branches $B_1$ and $B_2$ are connected to the common port $P_1$. A pair of control voltages applied to control terminals $V_1$ and $V_2$ can set the switch in a first state of operation or a second state of operation according to the logic table given below.

TABLE 1

Logic table for prior art SP2T PIN diode switch of FIG. 1.

| Switch State | $V_1$ | $V_2$ | Circuit branch $B_1$ | Circuit branch $B_2$ |
|---|---|---|---|---|
| First State of Operation | 0 V | 5 V | Low Loss between $P_1$ and $P_2$ | High Isolation between $P_1$ and $P_3$ |
| Second State of Operation | 5 V | 0 V | High Isolation between $P_1$ and $P_2$ | Low Loss between $P_1$ and $P_3$ |

The switch of FIG. 1 includes PIN diodes $D_1$, $D_2$, $D_3$, $D_4$, where $D_1$ and $D_2$ are the respective shunt and series PIN diodes of circuit branch $B_1$ and where $D_3$ and $D_4$ are the respective shunt and series PIN diodes of circuit branch $B_2$ The switch further includes DC blocking capacitors $C_1$, $C_2$, $C_3$, $C_4$, $C_5$, $C_6$ which are selected so they have a very low impedance for RF signals within the operating frequency range of the switch. DC biasing components $C_7$ and $L_3$ provide a noise free DC voltage at node M, and DC biasing components $C_8$ and $L_4$ provide a noise free DC voltage at node N. DC biasing component $L_1$ provides a path to ground, via $R_1$, for a DC current arising from a nonzero voltage at node G, and similarly DC biasing component $L_2$ provides a path to ground, via $R_2$, for a DC current arising from a nonzero voltage at node H. Resistor $R_1$ is selected to regulate the current which can flow from node G to ground when a DC voltage is present at node G, and resistor $R_2$ is selected to regulate the current which can flow from node H to ground when a DC voltage is present at node H.

In the first state of operation of the RF switch of FIG. 1, diodes $D_2$ and $D_3$ are forward biased, and diodes $D_1$ and $D_4$ are reverse biased. An RF signal entering circuit branch $B_1$ of the switch at port $P_2$, will be substantially unaffected by reverse biased shunt PIN diode $D_1$ connected to node G, will pass through the forward biased series PIN diode $D_2$, will be isolated from circuit branch $B_2$ by reverse biased series PIN diode $D_4$, and hence will pass without significant attenuation to port $P_1$ of the SP2T RF switch of FIG. 1.

Any small percentage of the RF signal which can pass through reverse biased series PIN diode $D_4$ (due to the finite impedance of the reversed biased PIN diode $D_4$), will have a low resistance path to ground at node H via forward biased shunt PIN diode $D_3$ and capacitor $C_6$ (recall that the value of $C_6$ is chosen to be sufficiently large so that it has a low impedance for RF signals within the operating frequency range of the switch). Hence, the RF signal which enters the switch at $P_2$ will be highly isolated from port $P_3$ of the switch.

Consequently, in the first state of operation of the SP2T RF switch of FIG. 1, an RF signal entering the switch at port $P_2$, will pass without significant attenuation to common port $P_1$ of the switch and will be highly isolated from port $P_3$ of the switch. Similarly, an RF signal entering the switch at common port $P_1$, will pass without significant attenuation to port $P_2$ of the switch, and will be highly isolated from port $P_3$ of the switch.

In the second state of operation of the RF switch of FIG. 1, diodes $D_1$ and $D_4$ are forward biased, and diodes $D_2$ and $D_3$ are reverse biased. An RF signal entering circuit branch $B_2$ of the switch at port $P_3$, will be unaffected by reverse biased shunt PIN diode $D_3$ connected to node H, will pass through the forward biased series PIN diode $D_4$, will be isolated from circuit branch $B_1$ by reverse biased series PIN diode $D_2$, and hence will pass without significant attenuation to port $P_1$.

Any small percentage of the RF signal which can pass through reverse biased series PIN diode $D_2$, will have a low resistance path to ground at node G via forward biased shunt PIN diode $D_1$ and capacitor $C_5$. Hence, the RF signal which enters the switch at $P_3$ will be highly isolated from port $P_2$ of the switch.

Consequently, in the second state of operation of the SP2T RF switch of FIG. 1, an RF signal entering the switch at port $P_3$, will pass without significant attenuation to common port $P_1$ of the switch and will be highly isolated from port $P_2$ of the switch. Similarly, an RF signal entering the switch at common port $P_1$, will pass without significant attenuation to port $P_3$ of the switch, and will be highly isolated from port $P_2$ of the switch.

The SP2T RF switch depicted in FIG. 1 above operates very well within the frequency range of current worldwide cellular systems. However, at very high operating frequencies, such as the frequency band allocated for RF based automotive collision avoidance systems (centered at 24.125 GHz), a number of problems are encountered with the practical implementation of the SP2T RF switch depicted in FIG. 1.

As noted above, in the first state of operation of the SP2T RF switch of FIG. 1, an RF signal entering the switch at port $P_2$ is unaffected by the path of the circuit from node G to ground via reverse biased PIN diode $D_1$ and capacitor $C_5$ because of the high impedance presented by the reverse biased PIN diode $D_1$ connected to node G. This high impedance can be represented by a reflection co-efficient of +1 at node G due to the circuit path containing PIN diode $D_1$ and capacitor $C_5$.

In the second state of operation of the SP2T RF switch of FIG. 1, the high isolation of port $P_2$ from signals entering the switch at port $P_3$ or port $P_1$ is achieved by the combination of the high impedance of reversed biased series PIN diode $D_2$, and the low impedance path to ground at node G through forward biased shunt PIN diode $D_1$ and via capacitor $C_5$. The low impedance path to ground at node G via PIN diode $D_1$ and capacitor $C_5$ can be represented by a reflection co-efficient of −1.

In practical implementations, diode $D_1$ and capacitor $C_5$ will be soldered to a PCB and the PCB will include a first metal track which connects node G to the cathode of PIN diode $D_1$ and a second metal track which connects the anode of diode $D_1$ to capacitor C5.

These metal tracks will have a finite length, and the effect of these metal tracks will be to rotate the phase of the reflection co-efficient at node G due to the path containing PIN diode $D_1$ and capacitor $C_5$ so that it will no longer have the ideal value of +1 in the first state of operation of the RF switch of FIG. 1, or −1 in the second state of operation. The phase rotation caused by the finite lengths of metal tracks which connect node G, PIN diode $D_1$ and capacitor $C_5$ will introduce a substantial loss due to the reverse biased PIN diode $D_1$ in the first state of operation of the SP2T RF switch of FIG. 1 and will substantially reduce the isolation offered by the forward biased PIN diode $D_3$ in the second state of operation of the SP2T RF switch of FIG. 1.

At operating frequencies of 24 GHz, a metal track length of only 1 mm or 2 mm will have a significant effect on the phase of the reflection co-efficient at node G, thereby substantially increasing the loss between ports $P_1$ and $P_2$ and substantially reducing the isolation between ports $P_1$ and $P_3$ in the first operation state of the SP2T RF switch of FIG. 1.

A similar analysis reveals that the effect of the finite lengths of metal tracks required to connect node H, PIN diode $D_3$ and capacitor $C_6$ substantially increases the loss between ports $P_1$ and $P_3$, and substantially reduces the isolation between ports $P_1$ and $P_2$ in the second operation state of the SP2T RF switch of FIG. 1.

DISCLOSURE OF THE INVENTION

The invention disclosed herein comprises an RF switch as claimed in claim 1.

BRIEF DESCRIPTION OF THE DRAWINGS

Embodiments of the invention will now be described, by way of example, with reference to the accompanying drawings in which.

DESCRIPTION OF PREFERRED EMBODIMENTS OF THE INVENTION

The invention disclosed herein is illustrated primarily by SP2T embodiments as the structure of an SP2T switch is convenient for the description of the main features of the invention, and for highlighting the differences between the invention disclosed and prior art RF switches. However the invention applies equally to SPNT RF switches (where N=1, N=3, N=4, etc) as it does to the SP2T RF switch.

Figure 2:
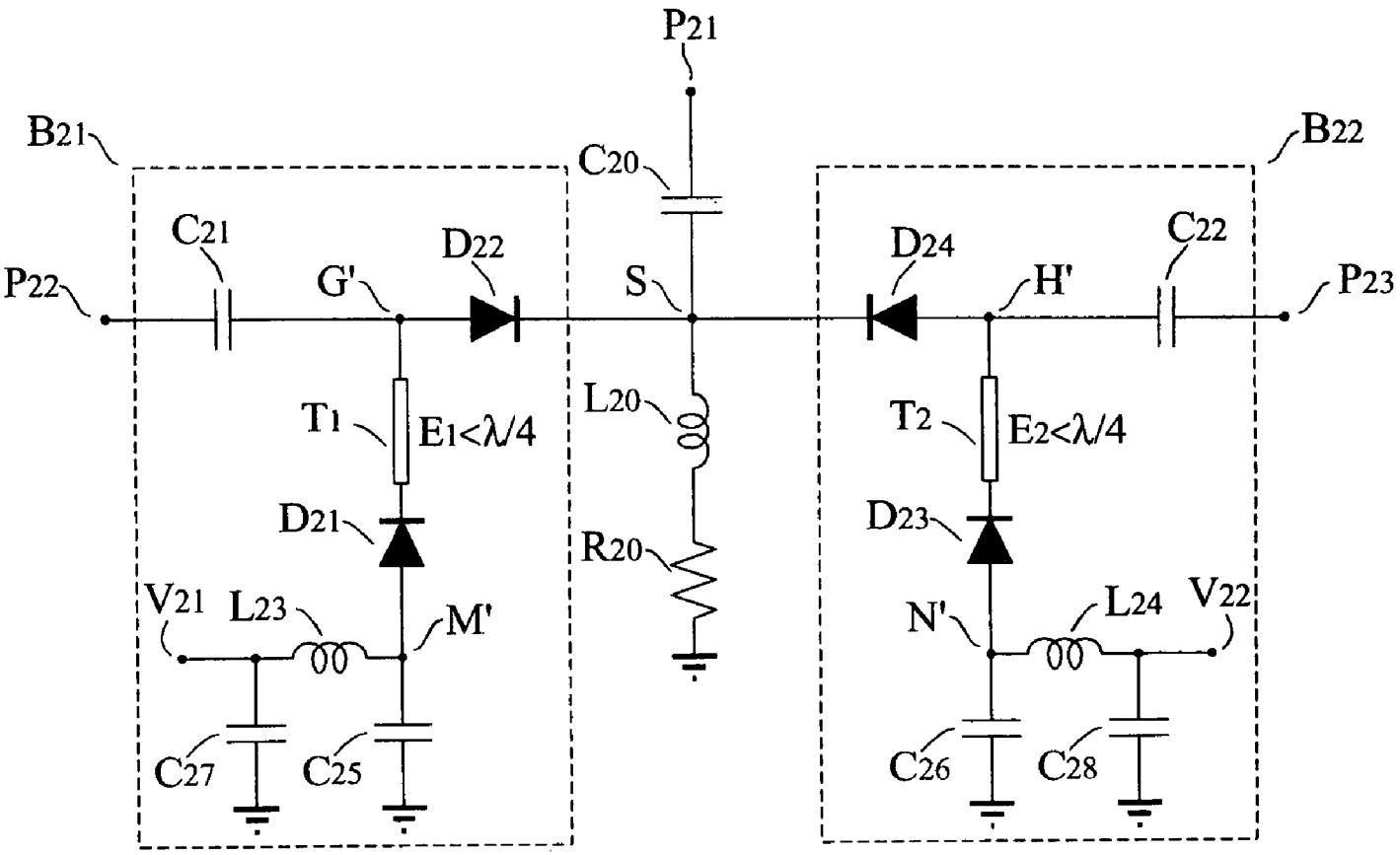
FIG. 2 shows a SP2T PIN diode switch of the first preferred embodiment of the present invention.

FIG. 2 shows a SP2T RF switch according to a first preferred embodiment of the present invention. The SP2T RF switch of FIG. 2 is a 3 port device comprising a pair of input/output ports $P_{22}$, $P_{23}$, and a common port $P_{21}$. The switch includes two circuit branches $B_{21}$, $B_{22}$, where input/output port $P_{22}$ is connected to one end of circuit branch $B_{21}$, and where input/output port $P_{23}$ is connected to one end of circuit branch $B_{22}$, and where the other ends of both branches $B_{21}$ and $B_{22}$ are connected to a common node S.

The switch of FIG. 2 includes PIN diodes $D_{21}$, $D_{22}$, $D_{23}$, $D_{24}$, where $D_{21}$ and $D_{22}$ are the respective shunt and series PIN diodes of circuit branch $B_{21}$ and where $D_{23}$ and $D_{24}$ are the respective shunt and series PIN diodes of circuit branch $B_{22}$.

The switch includes DC blocking capacitors $C_{20}$, $C_{21}$, $C_{22}$, $C_{25}$, $C_{26}$ which are selected so they have a very low impedance for RF signals within the operating frequency range of the switch. DC biasing components $C_{27}$ and $L_{23}$ provide a noise free DC voltage at node M', and DC biasing components $C_{28}$ and $L_{24}$ provide a noise free DC voltage at node N'. DC biasing component $L_{20}$ provides a path to ground via $R_{20}$ for a DC current arising from a nonzero voltage at node S, and resistor $R_{20}$ is selected to regulate the current which flows to ground from node S when a DC voltage is present at node S.

The switch further includes a pair of transmission lines $T_1$ and $T_2$ which are connected between node G' and shunt PIN diode $D_{21}$, and between node H' and shunt PIN diode $D_{23}$ respectively. Transmission lines $T_1$ and $T_2$ are included in the SP2T RF switch of FIG. 2 to rotate the phase of the reflection co-efficient at node G' due to the path to ground via components $T_1$, $D_{21}$, $C_{25}$, and to rotate the phase of the reflection co-efficient at node H' due to the path to ground via components $T_2$, $D_{23}$ and $C_{26}$ respectively.

It was noted earlier that a the reflection co-efficient arising from a very low impedance path to ground (or a short circuit) is −1, and that the reflection co-efficient arising from a very high impedance path to ground (or open circuit) is +1. In both cases, the magnitude of the reflection co-efficient has a value of unity, and the difference is just the phase of the reflection co-efficient.

The effect of connecting a first end of a finite length of metal track or a transmission line to a short circuit or to an open circuit is to rotate the phase of the reflection coefficient at the second end of the metal track by a particular angle. More generally, the effect of connecting a first end of a finite length of metal track to some point in a circuit which gives rise to a reflection co-efficient of $\Gamma_1$, where the magnitude of $\Gamma_1$, is unity, is to rotate the phase of the reflection co-efficient at the second end of the length of metal track by an angle θ, so that it is given by the expression for $\Gamma_2$ in equation 1 below.

$$\Gamma_2=\Gamma_1\times e^{-j\theta} \quad (1)$$

Specifically, if a first end of a finite length of metal track with a length l is connected to some point in a circuit which gives rise to a reflection co-efficient of $\Gamma_1$, the angle of rotation θ(in degrees) of the reflection co-efficient at the second end of the metal track is given by the expression in equation 2 below $$\theta=\frac{180}{\pi}\times\frac{2\omega l}{c} \quad (2)$$

where ω is the operating frequency and where c is the phase velocity of the propagation of an electromagnetic wave along the metal track.

In the case where the electrical length of the metal track is equal to one quarter of the wavelength of the operating frequency in question, the reflection co-efficient at the second end of the metal track will be rotated by 180 degrees, so that the reflection coefficients at each end of the length of metal track are given by the expression in equation 3 below.

$$\Gamma_2=-\Gamma_1 \quad 3$$

Consider the case when PIN diodes $D_{21}$, and $D_{23}$ of the SP2T RF switch of FIG. 2 are reverse biased; in this case the PIN diodes $D_{21}$, and $D_{23}$ will each present a high impedance: D21 in the path from node G' to ground, and $D_{23}$ in the path from node H' to ground. The reflection co-efficient at node G' due to the path containing components $T_1$, $D_{21}$, $C_{25}$ will be determined by the very high impedance of PIN diode $D_{21}$, connected in series with transmission line $T_1$, and any metal tracks required to connect PIN diode $D_{21}$ to transmission line $T_1$ and to connect transmission line $T_1$ to node G' (which are also connected in series with components $T_1$, $D_2$). Similarly the reflection co-efficient at node H' due to the path containing components $T_2$, $D_{23}$, $C_{26}$ will be determined by the very high impedance of PIN diode $D_{23}$, connected in series with transmission line $T_2$, and any metal tracks required to connect PIN diode $D_{23}$ to transmission line $T_2$ and to connect transmission line $T_2$ to node H' (which are also connected in series with components $T_1$, $D_2$).

Hence, at node G' the reflection co-efficient will given by equation 1, where $\Gamma_1$, will be approximately +1 (due to the high impedance of the reverse biased PIN diode $D_{21}$) and where θ will be equal to the sum of the phase rotations due to the length of metal track required to connect the cathode of PIN diode $D_{21}$ to one end of transmission line $T_1$, the phase rotation due to transmission line $T_1$ itself, and the phase rotation due to the length of metal track required to connect the other end transmission line $T_1$ to node G'. In the present invention, the length of transmission line $T_1$ is chosen so that θ is 180 degrees. Thus, the reflection co-efficient at node G' due to the path containing components $T_1$, $D_{21}$, $C_{25}$ will be −1 when PIN diode $D_{21}$ is in the reverse biased state.

Similarly the length of transmission line $T_2$ is chosen so that the sum of the phase rotations due to the length of metal track required to connect the cathode of PIN diode $D_{23}$ to one end of transmission line $T_2$, the phase rotation due to transmission line $T_2$ itself, and the phase rotation due to the length of metal track required to connect the other end of transmission line $T_2$ to node H' is also 180 degrees. Hence the reflection co-efficient at node H' due to the path containing components $T_2$, $D_{23}$, $C_{26}$ will also be −1 when PIN diode $D_{23}$ is in the reverse biased state.

Since the path from node G' to ground includes the metal tracks which are required to physically connect node G' to transmission line $T_1$, and to connect transmission line $T_1$ to PIN diode $D_{21}$ as described above, the electrical length $E_1$ of transmission line $T_1$ is necessarily less than one quarter of the wavelength of the centre frequency of the operating band of the switch. Similarly, since the path from node H' to ground includes the metal tracks which are required to physically connect node H' to transmission line $T_2$, and to connect transmission line $T_2$ to PIN diode $D_{23}$, the electrical length $E_2$ of transmission line $T_2$ is also necessarily less than one quarter of the wavelength of the centre frequency of the operating band of the switch. This is illustrated by the expression $E_1<\lambda/4$ adjacent to transmission line $T_1$ and the expression $E_2<\lambda/4$ adjacent to transmission line $T_2$ in FIG. 2.

A reflection co-efficient of −1 is that which arises from an infinitely small impedance to ground, so it can be seen that in the SP2T RF switch of FIG. 2, the pin diodes $D_{21}$ and $D_{23}$ will present very low impedances at nodes G' and H' when they are reverse biased.

Now, consider the case when PIN diodes $D_{21}$, and $D_{23}$ of the SP2T RF switch of FIG. 2 are forward biased; in this case the PIN diodes $D_{21}$, and $D_{23}$ each will present low impedances: $D_{21}$ in the path from node G' to ground, and $D_{23}$ in the path from node H' to ground. The reflection co-efficient at node G' due to the path to ground via components $T_1$, $D_{21}$, $C_{25}$ will be determined by the very low impedance of capacitor $C_{25}$, connected in series with the low impedance of PIN diode $D_{21}$, connected in series with transmission line $T_1$, and any metal tracks required to connect the components together (which are also connected in series with components $T_1$, $D_{21}$, $C_{25}$). Similarly, the reflection co-efficient at node H' due to the path to ground via components $T_2$, $D_{23}$, $C_{26}$ will be determined by the very low impedance of capacitor $C_{26}$, connected in series with the low impedance of PIN diode $D_{23}$, connected in series with transmission line $T_2$, and due to any metal tracks required to connect the components together (which are also connected in series with components $T_2$, $D_{23}$, $C_{26}$).

In each case, the reflection co-efficient will given by the expression for $\Gamma_2$ in equation 1, where $\Gamma_1$ is approximately −1 (due to the low impedance path to ground at the cathode of PIN diode $D_{21}$ and via capacitor $C_{25}$ and due to the low impedance path to ground at the cathode of PIN diode $D_{23}$ via capacitor $C_{26}$) and where θ is approximately 180 degrees. Thus the reflection co-efficient at node G' due to the path to ground via components $T_1$, $D_{21}$, $C_{25}$ will be +1, and that at node H' due to the path to ground via components $T_2$, $D_{23}$, $C_{26}$ will also be +1 when PIN diodes $D_{21}$ and $D_{23}$ are forward biased.

A reflection co-efficient of +1 is that which arises from a infinitely large impedance, so it can be seen that in the SP2T RF switch of FIG. 2, the pin diodes $D_{21}$ and $D_{23}$ will present very high impedances at nodes G' and H' (and hence are effectively isolated from nodes G' and H') when they are forward biased.

A pair of control voltages applied to control terminals $V_{21}$ and $V_{22}$ can set the SP2T RF switch of FIG. 2 in a first state of operation or a second state of operation according to the logic table given below.

TABLE 2

Logic table for SP2T PIN diode switch of FIG. 2.

| Switch State | $V_{21}$ | $V_{22}$ | Circuit branch $B_{21}$ | Circuit branch $B_{22}$ |
|---|---|---|---|---|
| First State of Operation | 5 V | 0 V | Low Loss between $P_{21}$ and $P_{22}$ | High Isolation between $P_{21}$ and $P_{23}$ |
| Second State of Operation | 0 V | 5 V | High Isolation between $P_{21}$ and $P_{22}$ | Low Loss between $P_{21}$ and $P_{23}$ |

In the first state of operation of the SP2T RF switch of FIG. 2, the voltage at the anode of PIN diode $D_{21}$ (connected to node M') is 5 Volts, the voltages at the cathode of PIN diode $D_{21}$ and at the anode of PIN diode $D_{22}$ (both connected to node G') are $5-V_{TH}$ Volts, and the voltage at the cathode of PIN diode $D_{22}$ (connected to node S) is $5-2\times V_{TH}$ Volts. Hence, both PIN diodes $D_{21}$ and $D_{22}$ will be forward biased in the first state of operation of the SP2T RF switch of FIG. 2.

The voltage at the cathode of PIN diode $D_{24}$, (also connected to node S) is $5-2\times V_{TH}$ Volts and that at the anode of PIN diode $D_{24}$ (connected to node H'), is given approximately by the expression in equation 4 below.

$$V_{H'} = \frac{1}{2}(5 - 2\times V_{TH}) \quad 4$$

The expression in equation 4 can be deduced from the fact that diodes $D_{24}$ and $D_{23}$ will act as a voltage divider between node S and the potential of zero Volts at control terminal $V_{22}$.

The voltage at the cathode of PIN diode $D_{23}$ (also connected to node H') is also given by the expression in equation 4, and the voltage at the anode of PIN diode $D_{23}$ i.e. zero Volts—since is this is connected to control terminal $V_{22}$ which is at zero Volts. Hence both PIN diodes $D_{23}$, and $D_{24}$ will be reversed biased in the first state of operation of the SP2T RF switch of FIG. 2.

Consequently, in the first state of operation of the SP2T RF switch of FIG. 2, diodes $D_{21}$ and $D_{22}$ will be forward biased, and diodes $D_{23}$ and $D_{24}$ will be reverse biased.

The analysis in the preceding section showed that the reflection co-efficient arising from the path to ground from node G' via transmission line $T_1$, PIN diode $D_{21}$, and capacitor $C_{25}$ will be +1 when PIN diode $D_{21}$ is forward biased. A reflection co-efficient of +1 is that which arises from a very high impedance path to ground or an open circuit. Therefore, in the first state of operation of the SP2T RF switch of FIG. 2, an RF signal entering circuit branch $B_{21}$ of the switch at port $P_{22}$, will be unaffected by the open circuit at node G', will then pass through the forward biased PIN diode $D_{22}$, will be isolated from circuit branch $B_{23}$ by reverse biased PIN diode $D_{24}$, and hence will pass without significant attenuation to port $P_{21}$.

The analysis in the preceding section also showed that the reflection co-efficient arising from the path to ground from node H' via transmission line $T_2$, PIN diode $D_{23}$, and capacitor $C_{26}$ will be −1 when PIN diode $D_{23}$ is reverse biased. A reflection co-efficient of −1 is that which arises from a very low impedance path to ground or a short circuit. Any small percentage of the RF signal which can pass through reverse biased PIN diode $D_{24}$ (due to the finite impedance of the reversed biased PIN diode $D_{24}$), will have a low resistance path to ground at node H' via transmission line $T_2$, reverse biased PIN diode $D_{23}$, and capacitor $C_{26}$. Hence, the RF signal which enters the switch at $P_{22}$ will be highly isolated from port $P_{23}$ of the switch.

In summary, in the first state of operation of the SP2T RF switch of FIG. 2, an RF signal entering the switch at port $P_{22}$, will pass without significant attenuation to common port $P_{21}$ of the switch and will be highly isolated from port $P_{23}$ of the switch. Similarly, an RF signal entering the switch at common port $P_{21}$, will pass without significant attenuation to port $P_{22}$ of the switch, and will be highly isolated from port $P_{23}$ of the switch.

In the second state of operation of the SP2T RF switch of FIG. 2, the voltage at the anode of PIN diode $D_{23}$ (connected to node N') is 5 Volts, the voltages at the cathode of PIN diode $D_{23}$ and at the anode of PIN diode $D_{24}$ (both connected to node H') are $5-V_{TH}$ Volts, and the voltage at the cathode of PIN diode $D_{24}$ (connected to node S) is $5-2\times V_{TH}$ Volts. Hence, both PIN diodes $D_{23}$ and $D_{24}$ will be forward biased in the second state of operation of the SP2T RF switch of FIG. 2.

The voltage at the cathode of PIN diode $D_{22}$, (also connected to node S) is $5-2\times V_{TH}$ Volts and that at the anode of PIN diode $D_{22}$ (connected to node G'), is given approximately by the expression in equation 4 above.

The voltage at the cathode of PIN diode $D_{21}$ (also connected to node G') is also given by the expression in equation 4, and the voltage at the anode of PIN diode $D_{21}$ is zero Volts—since this is connected to control terminal $V_{21}$ which is at zero Volts. Hence both PIN diodes $D_{21}$, and $D_{22}$ will be reversed biased in the second state of operation of the SP2T RF switch of FIG. 2.

Consequently, in the second state of operation of the SP2T RF switch of FIG. 2, diodes $D_{23}$ and $D_{24}$ will be forward biased, and diodes $D_2$, and $D_{22}$ will be reverse biased.

In the second state of operation of the RF switch of FIG. 2, an RF signal entering circuit branch $B_{22}$ of the switch at port $P_{23}$, will be unaffected by the open circuit at node H', will then pass through the forward biased PIN diode $D_{24}$, will be isolated from circuit branch $B_{22}$ by reverse biased PIN diode $D_{22}$, and hence will pass without significant attenuation to port $P_{21}$.

Any small percentage of the RF signal which can pass through reverse biased PIN diode $D_{22}$, will have a low resistance path to ground at node G' via transmission line $T_1$, reverse biased PIN diode $D_{21}$, and capacitor $C_{25}$. Hence, the RF signal which enters the switch at $P_{23}$ will be highly isolated from port $P_{21}$ of the switch.

In summary, in the second state of operation of the SP2T RF switch of FIG. 2, an RF signal entering the switch at port $P_{23}$, will pass without significant attenuation to common port $P_{21}$ of the switch and will be highly isolated from port $P_{22}$ of the switch. Similarly, an RF signal entering the switch at common port $P_{21}$, will pass without significant attenuation to port $P_{23}$ of the switch, and will be highly isolated from port $P_{22}$ of the switch.

A surprising benefit of the preferred embodiment of the present invention of FIG. 2 results is from the fact that the PIN diodes are biased in series, as opposed to being biased in parallel in the various embodiments of an SP2T RF switch proposed by Ertel in U.S. Pat. No. 3,475,700 and by Iwata et al in U.S. Pat. No. 4,220,874.

The power consumed by the SP2T RF switch of FIG. 2 in either state is equal to the bias voltage multiplied by the total current flowing through the various paths to ground. For example, in the first state of operation of the SP2T RF switch of FIG. 2, the power is given by the expression in equation 5 below.

$$P = V_{21} i_D = 5 \times \frac{5 - V_{D21} - V_{D22}}{R_{20}} \tag{5}$$

Where $i_D$ is the current flowing through PIN diodes $D_{21}$, and $D_{22}$ in the first state of operation of the switch of FIG. 2, and where $V_{D21}$ and $V_{D22}$ are the voltages across PIN diodes $D_{21}$ and $D_{22}$ respectively.

Figure 1:
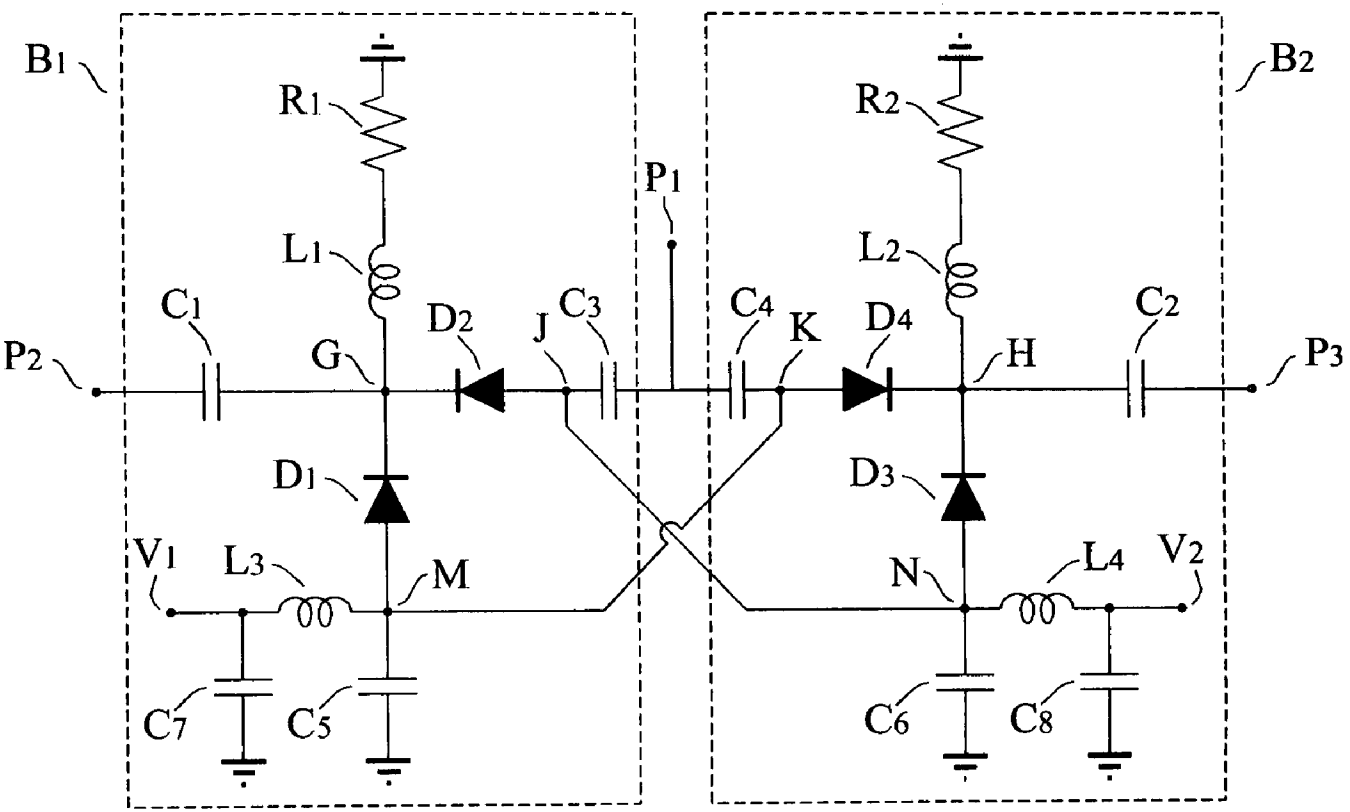
Figure 1 (Prior Art)
FIG. 1 shows a prior art SP2T PIN diode switch.

The power consumed by the prior art SP2T RF switch of FIG. 1 in either state is also equal to the bias voltage multiplied by the total current flowing through the various paths to ground. For example, in the first state of operation of the SP2T RF switch of FIG. 1, the power consumed by the switch is given by the expression in equation 6 below.

$$P = V_1(i_{D2} + i_{D3}) = 5 \times \left(\frac{5 - V_{D2}}{R_1} + \frac{5 - V_{D3}}{R_2}\right) \tag{6}$$

Where $i_{D2}$ is the current flowing through PIN diode $D_2$ and $i_{D3}$ is the current flowing through PIN diode $D_3$ and where $V_{D2}$ and $V_{D3}$ are the voltages across PIN diodes $D_2$ and $D_3$ respectively in the first state of operation of the switch of FIG. 1.

Assuming that the values of $R_1$, $R_2$ and $R_{20}$ are selected so that a given current flows through PIN diodes $D_2$ and $D_3$ in the switch of FIG. 1, and so that the same current flows through PIN diodes $D_{21}$, and $D_{22}$ in the switch of FIG. 2, then the value of the power consumed given by equation 6 must be two times greater than that given by equation 5, and hence that the SP2T RF switch of the preferred embodiment of the present invention depicted in FIG. 2 will consume half of the power of the prior art SP2T RF switch depicted in FIG. 1.

It can also be seen that the SP2T RF switch of FIG. 2 has a considerably simpler biasing arrangement, than the SP2T RF switch of FIG. 1. In particular, the SP2T RF switch of FIG. 2 includes a single common DC bias inductor $L_{20}$ which is connected to node S, and this inductor is connected a single common current regulating resistor $R_{20}$; a single common DC is blocking capacitor $C_{20}$ is connected between node S and port $P_{21}$; these three components which are common to circuit branches $B_{21}$, and $B_{22}$ of FIG. 2, fulfill the same functionality as the components $L_1$, $L_2$, $C_3$, $C_4$, and $R_1$ and $R_2$ of the SP2T RF switch depicted in FIG. 1.

Figure 3:
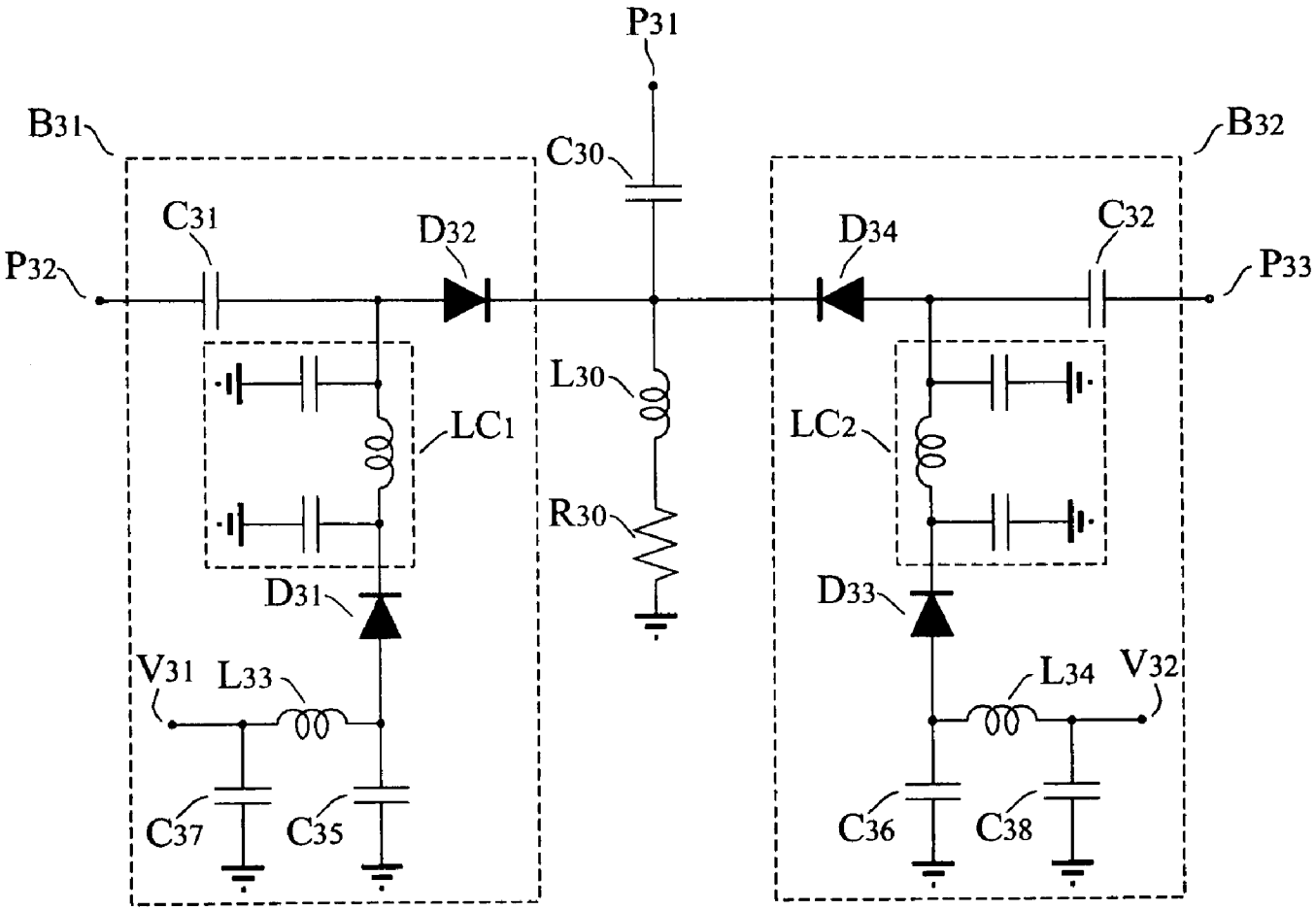
FIG. 3 shows a SP2T PIN diode switch of the second embodiment of the present invention.

FIG. 3 depicts a second embodiment of the present, wherein transmission lines $T_1$ and $T_2$ of the preferred embodiment of FIG. 2 have been replaced by discrete LC PI networks $LC_1$ and $LC_2$.

It was noted earlier that the effect of connecting a first end of a finite length of metal track to some point in a circuit which gives rise to a reflection co-efficient of $\Gamma_1$, where the magnitude of $\Gamma_1$ is unity, is to rotate the phase of the reflection co-efficient at the second end of the length of metal track by an angle $\theta$. More specifically, it was shown that when the length of the metal track is equal to one quarter of the wavelength of the operating frequency in question, the phase of the reflection co-efficient at the second end of the metal track will be rotated by 180 degrees.

Transmission lines $T_1$ and $T_2$ in the preferred embodiment of the present invention given in FIG. 2 are each selected so that a phase rotation of 180 degrees would result from the combined length of transmission line $T_1$ plus any metal tracks required to physically connect diode $D_{21}$, and capacitor $C_{25}$ in the path to ground from node G', and so that a phase rotation of 180 degrees would also result from the combined length of transmission line $T_2$ plus any metal tracks required to physically connect diode $D_{23}$ and capacitor $C_{26}$ in the path to ground from node H'. The 180 degrees phase rotation which results from the combination of lines and tracks transforms a reflection co-efficient of −1 at one end of the combination of lines and tracks to a reflection co-efficient of +1 at the other end, and vice versa.

Figure 4:
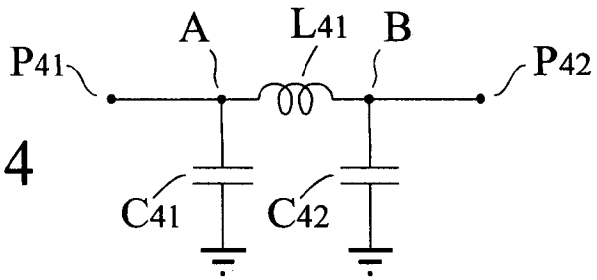
FIG. 4 shows a PI-type discrete LC network of FIG. 3 in more detail.

As shown in FIG. 3 and as discussed in more detail in relation to FIG. 4, the same effect can be achieved by a network of discrete components, such as the PI circuits $LC_1$ and $LC_2$. Referring to FIG. 4, assume that an impedance which gives rise to a reflection coefficient of either +1 or −1 is connected at port $P_{41}$ of the PI-type discrete LC network.

For the case where the reflection co-efficient at port $P_{41}$ is equal to +1, the phase rotation produced by capacitor $C_{41}$ on the reflection co-efficient at node A will be 90 degrees when the value of capacitor $C_{41}$ is given by the expression in equation 7 below.

$$C_{41} = \frac{1}{2\pi f_0 Z_0} \tag{7}$$

where $Z_0$ is the characteristic impedance of the source into which the reflection co-efficient is measured, and where $f_0$ is the frequency of operation.

Similarly, in the PI-type discrete LC network of FIG. 4, a phase rotation of 90 degrees will produced by inductor $L_{41}$ when the value of inductor $L_{41}$ is given by the expression in equation 8 below.

$$L_{41} = \frac{Z_0}{2\pi f_0} \tag{8}$$

Thus, the combined phase rotation of capacitor $C_{41}$ and inductor $L_{41}$ will be equal to 180 degrees, so that the reflection co-efficient at node B due to the impedance at port $P_{41}$ and due to capacitor $C_{41}$ inductor $L_{41}$ will be −1. Since a reflection co-efficient of −1 is equivalent to a short circuit, capacitor $C_{42}$ will have no effect on the circuit in this case, and the reflection co-efficient at port $P_{42}$ will be −1 as required.

For the case where the reflection co-efficient at port $P_{41}$ is equal to −1, capacitor $C_{41}$ has no effect on the short circuit at node A and $L_{41}$ will produce a phase rotation of 90 degrees when it's value is given by the expression in equation 8 as before.

In this case, the phase rotation produced by capacitor $C_{42}$ will be 90 degrees when the value of capacitor $C_{42}$ is given by the expression in equation 9 below.

$$C_{42} = \frac{1}{2\pi f_0 Z_0} \tag{9}$$

Thus the combined phase rotation of inductor $L_{41}$ and capacitor $C_{42}$ will be equal to 180 degrees, so that the reflection co-efficient at node B due to the impedance at port $P_{41}$ and due to inductor $L_{41}$ and capacitor $C_{42}$ will be +1 as required.

If the values of the capacitors and inductors in discrete LC networks $LC_1$ and $LC_2$ in the embodiment of the SP2T RF switch of FIG. 3 are chosen so that they are slightly less than the values given in equations 7, 8 and 9, (a slight reduction is required to allow for the finite lengths of metal tracks which are required to physically connect the components together as before), the circuit of FIG. 3 will have the same electrical characteristics as the preferred embodiment of the present invention given by the circuit of FIG. 2.

The simplest form of RF switch is the SP1T switch. An SP1T RF switch has a first input/output RF port, and a second input/output RF port and furthermore has two states of operation: an on state, whereby a low insertion loss path exists between the first and second input/output ports of the switch for RF signals within the operating frequency range of the switch, and an off state, whereby there is high isolation between the first and second input/output ports of the switch for RF signals within the operating frequency range of the switch.

Figure 5:
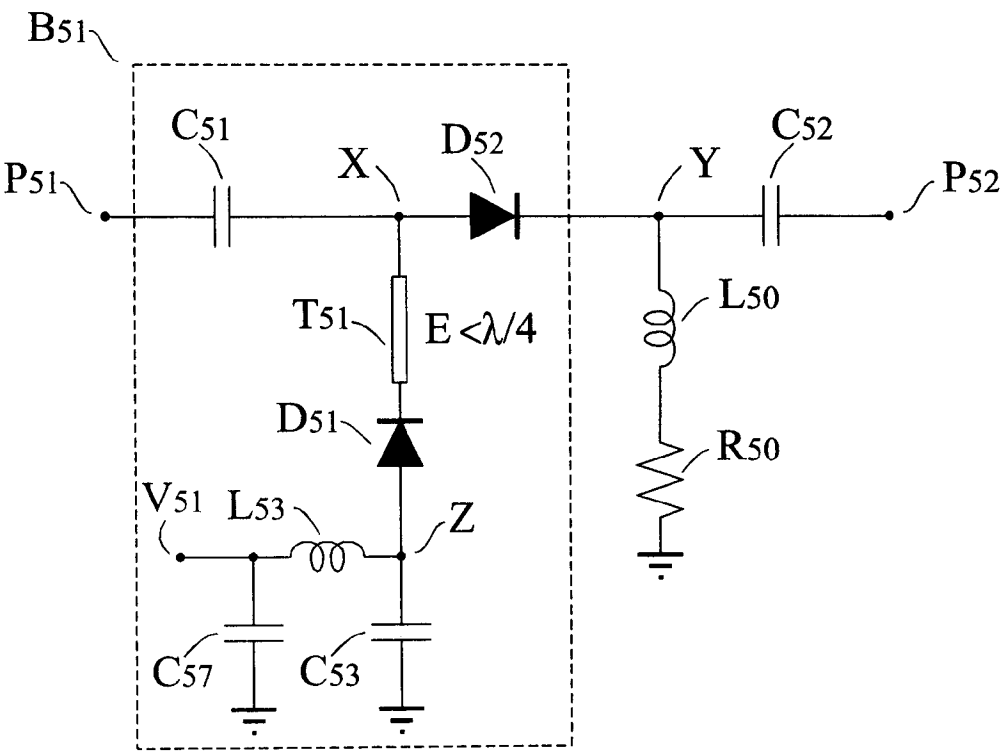
FIG. 5 shows a SP1T PIN diode switch of the third embodiment of the present invention.

An SP1T RF switch according to the present invention is given in FIG. 5. The circuit of FIG. 5 is an SP1T RF switch including a first input/output port $P_{51}$, and a second input/output port $P_{52}$. The circuit of FIG. 5 comprises a shunt PIN diode $D_{51}$, and a series PIN diode $D_{52}$, the circuit further includes DC blocking capacitors $C_{51}$, $C_{52}$ and $C_{53}$. The anode of PIN diode $D_{51}$ is connected to ground via DC blocking capacitor $C_{53}$, and the cathode of diode $D_{51}$ is connected to node X of the circuit via transmission line $T_{51}$. As with the SP2T switch of the preferred embodiment of the present invention, illustrated in FIG. 2, the length of transmission line $T_{51}$ is chosen so that a combined phase rotation of 180 degrees results from the metal track required to physically connect the cathode of PIN diode $D_{51}$ to transmission line $T_{51}$, from the transmission line $T_{51}$ itself, and from the metal track required to connect transmission line $T_{51}$ to node X of the circuit. As before, this arrangement gives rise to a reflection co-efficient of +1 at node X of the circuit due to the path to ground via transmission line $T_{51}$, PIN diode $D_{51}$, and capacitor $C_{53}$ when PIN diode $D_{51}$ is in its on-state, and similarly gives rise to a reflection co-efficient of −1 at node X of the circuit due to the path to ground via transmission line $T_{51}$, PIN diode $D_{51}$, and capacitor $C_{53}$ when PIN diode $D_{51}$ is in its off-state.

DC biasing components inductor $L_{50}$ and resistor $R_{50}$ are coupled to node Y of the circuit. A single voltage control terminal $V_{51}$ is coupled to node Z of the circuit via DC biasing components inductor $L_{53}$ and capacitor $C_{57}$.

The SP1T RF switch of FIG. 5 is in its on-state when a positive voltage is applied at control terminal $V_{51}$; the switch of FIG. 5 is in its off-state when a negative voltage or when zero volts are applied at control terminal $V_{51}$.

A prior art embodiment of an SP1T RF switch is illustrated by Iwata et al in FIG. 1 of U.S. Pat. No. 4,220,874. It will be noted that the SP1T of FIG. 5 of the present invention is substantially different from the SP1T illustrated by Iwata et al in FIG. 1 of U.S. Pat. No. 4,220,874. In addition to providing an SP1T RF switch suitable for high frequency operation (say 24 GHz) the present invention offers an SP1T switch which only draws current in its on-state. This is a considerable benefit in RF switch applications where the switch is required to be in its off-state for a larger percentage of the time than it is required to be in its on-state and in particular for battery powered RF applications.

As was the case for the SP2T RF switch of the preferred embodiment of the present invention, the SP1T RF switch of FIG. 5 consumes half the power of the SP1T switch illustrated by Iwata et al in FIG. 1 of U.S. Pat. No. 4,220,874 when both switches are in the on-state.

Because of the relatively simple biasing circuit required in the preferred embodiment of the present invention given in FIG. 2 or the alternative of FIG. 3; the addition of extra circuit branches to create SPNT RF switch (where N is greater than 2) is simply a matter of creating additional circuit branches where the components in the additional circuit branches have the same layout and same values as those of circuit branch $B_{21}$ or $B_{22}$ of the SP2T RF switch of FIG. 2; or circuit branch $B_{31}$ or $B_{32}$ of the SP2T RF switch of FIG. 3.

Figure 6:
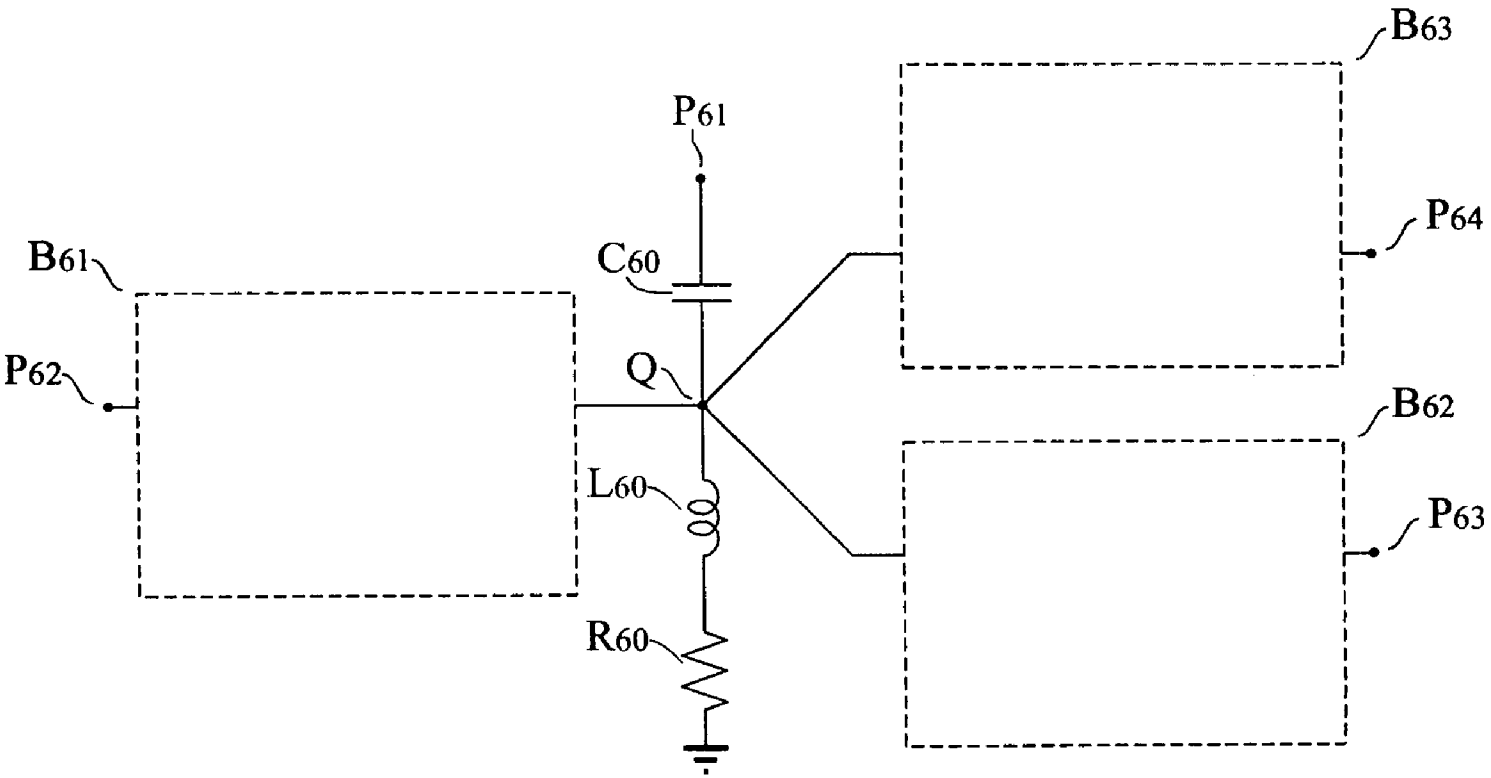
FIG. 6 shows a SP3T PIN diode switch of the fourth embodiment of the present invention.

So, for example, an SP3T RF switch based on the present invention is shown in FIG. 6. The SP3T RF switch of FIG. 6 is a 4 port device comprising input/output ports $P_{62}$, $P_{63}$, $P_{64}$, and common port $P_{61}$. The switch includes three circuit branches $B_{61}$, $B_{62}$, $B_{63}$, comprising either the circuitry of branches $B_{21}$, $B_{22}$; or $B_{31}$, $B_{32}$, and where input/output port $P_{62}$ is connected to one end of circuit branch $B_{61}$, input/output port $P_{63}$ is connected to one end of circuit branch $B_{62}$, input/output port $P_{64}$ is connected to one end of circuit branch $B_{63}$ and where the other ends of branches $B_{61}$, $B_{62}$, $B_{63}$, are connected to a common node Q.

In the first four embodiments of the present invention, PIN diodes were employed as the active devices which enabled switching between the states of operation of each embodiment.

Figure 7:
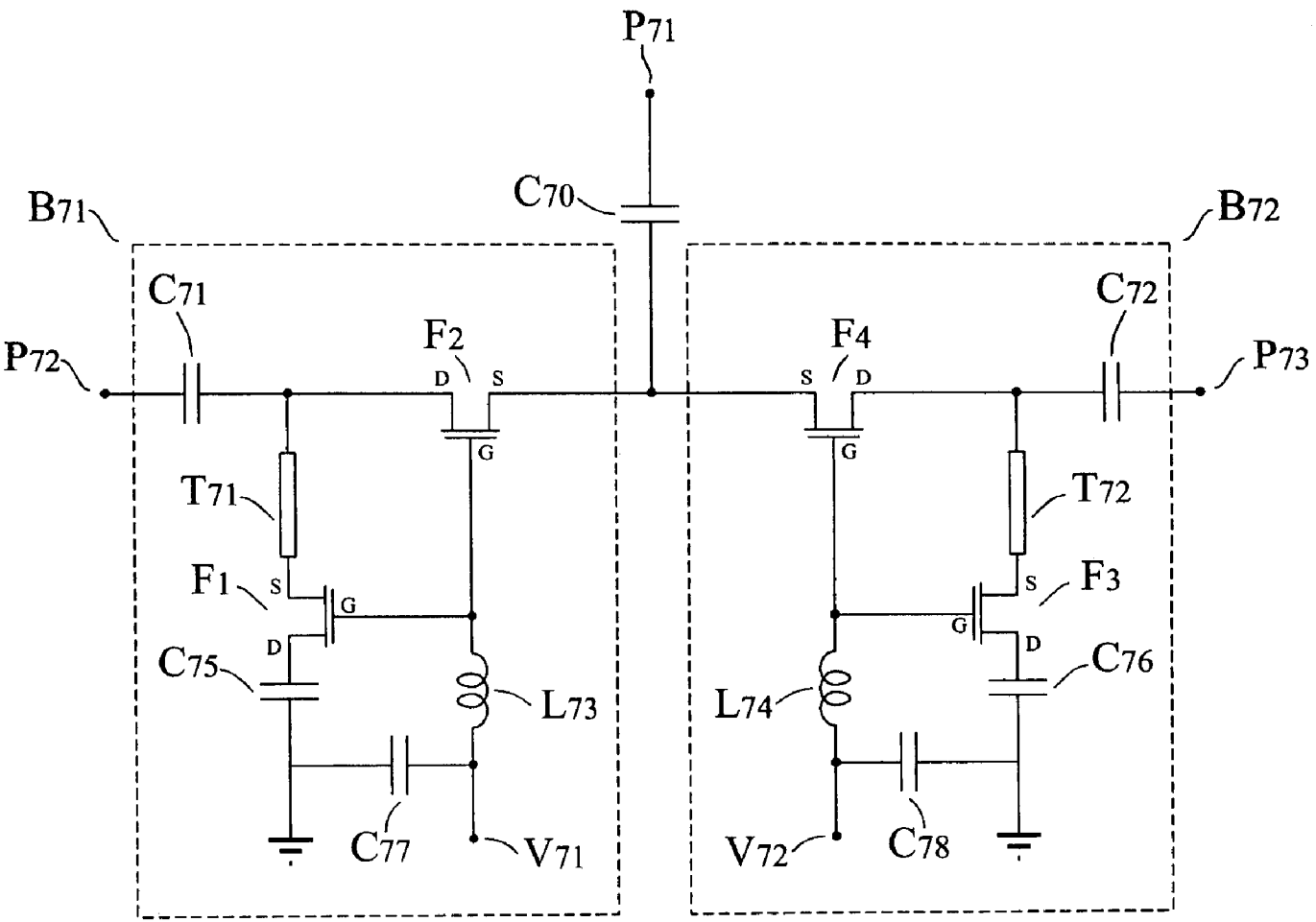
FIG. 7 shows a SP2T PIN diode switch of the fifth embodiment of the present invention.

The invention disclosed herein is not limited to embodiments employing PIN diodes. Any active device which can present a low resistance path between two ports of the device in one state, and which can alternatively present a high resistance path between the same two ports in another state of the device could be employed in the invention disclosed herein. For example, FIG. 7 depicts a SP2T RF switch where PIN diodes $D_{21}$ $D_{22}$, $D_{23}$ and $D_{24}$ of the preferred embodiment of FIG. 2, have been replaced by field effect transistors $F_1$, $F_2$, $F_3$, and $F_4$. As well as in the branch biasing circuitry, appropriate changes are required to the common circuitry by replacing the RLC networks of FIGS. 2-4 and 6 with the capacitor $C_{70}$. FETs $F_1$, $F_2$, $F_3$, and $F_4$ in the embodiment depicted in FIG. 7 could, for example, be n-channel enhancement mode MOSFETs, which are made to conduct from drain to source when the gate voltage is made positive relative to the source voltage and which become open circuit between the source and the drain when the gate voltage is equal to or negative relative to the source.

In FIG. 7, it can be seen that when $V_{71}$ is at +V Volts, and when $V_{72}$ is at 0 Volts, the gate of FET $F_1$ will be positive relative to its source, and similarly the gate of FET $F_2$ will be positive relative to its source; at the same time the gate of FET $F_4$ will be negative relative to its source, and that of FET $F_3$, will be at the same potential as the source. Hence, FET $F_1$ and FET $F_2$ will be in the on-state and FET $F_3$ and FET $F_4$ will be in the off-state. Comparison of the circuit of FIG. 7 as described above with that of FIG. 2 reveals that the RF characteristics between ports $P_{71}$, $P_{73}$ and $P_{73}$ of the SP2T RF switch of FIG. 7 are the same as those between ports $P_{21}$, $P_{22}$, and $P_{23}$ of the SP2T RF switch of FIG. 2, when the SP2T RF switch of FIG. 2 is in its first state of operation.

As in the case of the first and second embodiments, it will be seen that the branches $B_{71}$, $B_{72}$ of FIG. 7 can be used to implement SPNT switches as described with reference to FIG. 6 in particular.

The invention claimed is:

1. An RF switch having at least two operating states and comprising at least one circuit branch, wherein the at least one circuit branch comprises:

a first input/output port connected to a second input/output port via a series active device, a phase shifting component connected in series with a shunt active device, so that when the shunt active device is in an on state, the reflection co-efficient due to a path to ground from said series active device via said phase shifting component and the shunt active device is +1, and at least one control terminal to which a DC bias can be applied to control the state of the active devices, whereby in one of the operating states of the switch, both active devices are in the on state simultaneously, and in another of the operating states, both active devices are in an off state simultaneously.

2. The RF switch of claim 1 comprising a node adjacent to the first input/output port to which both the series active device and the phase shifting component are connected.

3. The RF switch of claim 2 wherein said shunt device is connected to said node via said phase shifting component.

4. The RF switch of claim 1 wherein said active devices are PIN diodes.

5. The RF switch of claim 1 wherein said active devices are field effect transistors.

6. The RF switch of claim 1 wherein said phase shifting component is selected from the group of: transmission line and PI network.

7. An SPNT switch comprising the RF switch of claim 1 having N of said circuit branches.

8. An antenna switch module (ASM) comprising an SPNT switch according to claim 7, each circuit branch second input/output port being connected to an antenna port via a common blocking capacitor.

9. An ASM as claimed in claim 8, wherein said active devices are PIN diodes, and wherein said blocking capacitor is connected to ground via a resistor/inductor network.

* * * * *